US005412912A

United States Patent [19]

Alves

[11] Patent Number: 5,412,912

[45] Date of Patent: May 9, 1995

[54] MODULAR SLATWALL ASSEMBLY

[75] Inventor: Manuel J. Alves, Charlotte, N.C.

[73] Assignee: Bo-Man, Inc., Charlotte, N.C.

[21] Appl. No.: 213,844

[22] Filed: Mar. 15, 1994

[51] Int. Cl.[6] ..... A47H 27/00

[52] U.S. Cl. ..... 52/36.5; 52/36.6; 52/511; 211/94; 211/94.5; 248/223.4; 403/396

[58] Field of Search ..... 52/27, 29, 36.4, 36.5, 52/36.6, 38, 510, 511, 512, 665; 211/94, 94.5; 248/223.4, 225.1, 250; 403/396, 388, 394

[56] References Cited

U.S. PATENT DOCUMENTS

| | | | |
|---|---|---|---|
| 2,319,278 | 5/1943 | Urbain | 35/67 |
| 3,005,293 | 10/1961 | Hunter | 50/399 |
| 4,262,465 | 4/1981 | Obrink | 52/510 |
| 4,505,611 | 3/1985 | Nagashima | 403/406 |
| 4,765,111 | 8/1988 | Osawa | 52/509 |
| 4,977,717 | 12/1990 | Niwata | 52/235 |

*Primary Examiner*—Carl D. Friedman
*Assistant Examiner*—Kien Nguyen
*Attorney, Agent, or Firm*—Ralph H. Dougherty

[57] ABSTRACT

A slatwall assembly having modular channels formed independently of the wallboard material, which channels are slidably adjustable in both a horizontal and vertical manner, and which can be installed in any desired configuration, the slatwall assembly having components which are lightweight and more easy to install than known systems. The modular slatwall assembly has an outer member, an inner support member, and a connector. Each outer member defines a front channel for receiving merchandise display devices and a rear channel. Each inner support member defines a support channel and is fixed in a generally vertical fashion to the inner supports of the wall structure. The outer member and inner support member are slidably connected by a connector having two disc-shaped heads connected by a central post. One head of the connector is slidably situated within the support channel of the inner support member and the other head is slidably situated within the rear channel of the outer member, thus allowing horizontal and/or vertical sliding movement of the outer member. The outer members are stabilized vertically by selectively placing horizontal segments of wall surface material therebetween and further between the lower outer member and the floor surface.

13 Claims, 3 Drawing Sheets

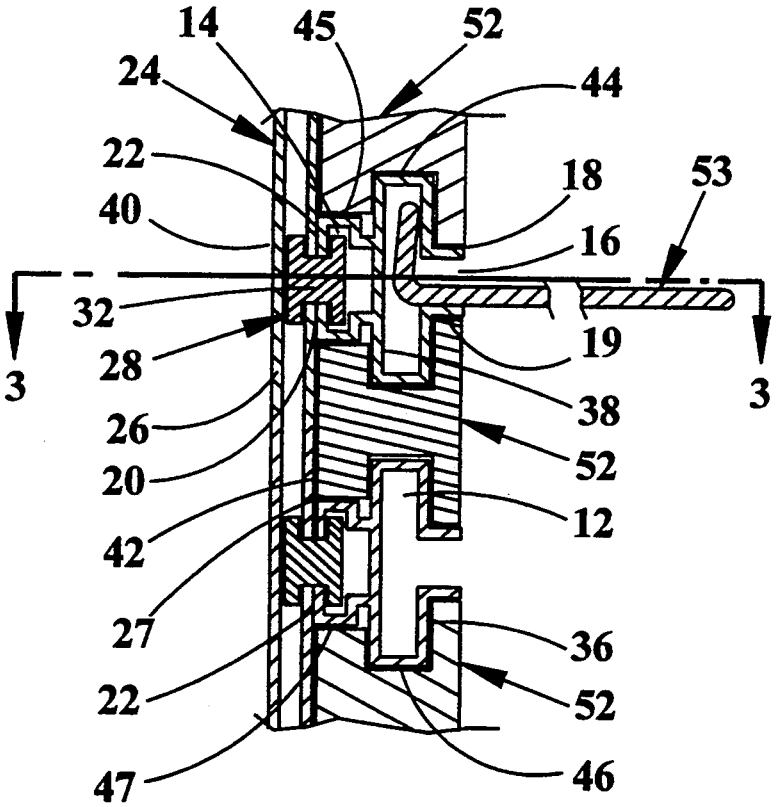
Fig.1
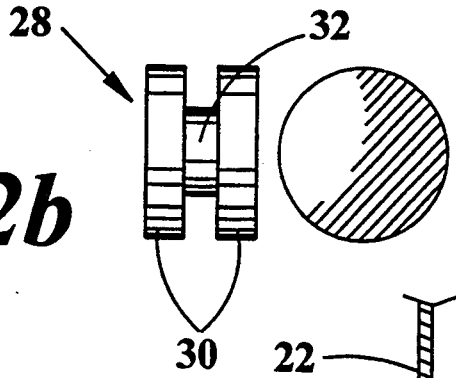
Fig.2a
Fig.2b
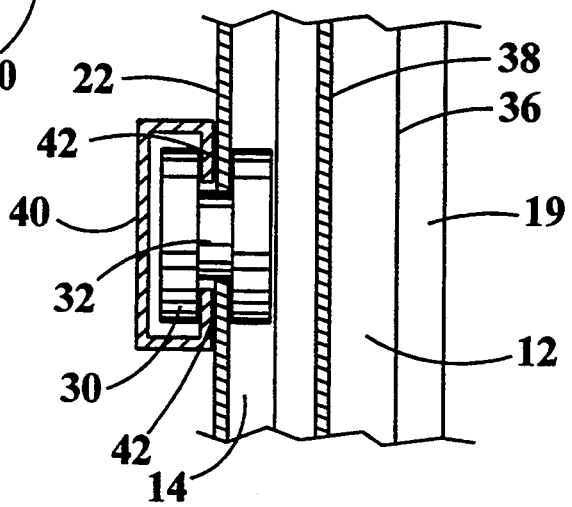
Fig.3

MODULAR SLATWALL ASSEMBLY

FIELD OF THE INVENTION

The present invention is an assembly for use in the construction of a wall surface to be formed with interior channels for securing merchandise display devices.

BACKGROUND OF THE INVENTION

Establishments that sell merchandise must make efficient use of the interior space of their store in order to maximize the amount of merchandise that can be displayed and thus, maximize sales. Efficient use of the space requires placing merchandise not only on the sales floor, but also utilizing the vertical space along the walls and columns of the sales floor.

It is known to adapt walls to hold display devices such as shelves, trays, and hooks by providing channels which extend horizontally across the wall. These channels generally have a narrow access slot extending through the surface of the wall leading to a larger, generally rectangular channel situated interior of the wall. The display devices or slatwall systems have an end adapted to extend through this access slot and into the channel to secure the device within the channel.

Existing slatwall systems employ wall surface materials with integrally formed horizontal channels. The wall surface is usually constructed of a thick, solid material, such as wallboard or plastic, with the slots and channels routered or molded into the material. These "built-in" channels are formed during the fabrication of the wall surface at the factory and then transported to the store for installation. This type of wall limits the ability of the store designer to choose and change the configuration of the channels within the wall. Furthermore, this type of slatwall is made of thick surface material, the thickness being necessitated by the depth of the channels. Additionally, this slatwall is also heavy due to the thickness of the wall material and can be difficult to handle and install. The need exists for a slatwall that is formed by channel members that are not formed integrally with the wall surface, but are formed and secured independently of the wall surface structure. A need also exists for an assembly for forming channels on a wall that is lightweight, easy to transport, easy to install, and adjustable such that the channels can be placed at any desired height, angle, or other configuration.

DESCRIPTION OF THE PRIOR ART

Applicant is aware of the following U.S. Patents concerning apparatus relevant to the invented modular slatwall system.

| U.S. Pat. No. | Expires | Inventor | Title |
|---|---|---|---|
| 2,319,278 | 05-18-1960 | Urbain | DISPLAY BOARD CONSTRUCTION |
| 3,005,293 | 10-24-1978 | Hunter | WALL FACING |
| 4,262,465 | 04-21-1998 | Öbrink | MOUNTED DEVICE FOR PANEL ELEMENTS, ESPECIALLY FOR BUILDINGS OR THE LIKE |
| 4,505,611 | 03-19-2002 | Nagashima | UPHOLSTERY FIXING DEVICE |
| 4,765,111 | 08-23-2005 | Osawa | ASSEMBLY FOR MOUNTING PLATES ON WALL |
| 4,977,717 | 12-18-2007 | Niwata | APPARATUS FOR MOUNTING PANEL MEMBER |

Urbain, U.S. Pat. No. 2,319,278 teaches a display board construction having horizontal members with clips and U-shaped rails for the attachment of trays or hooks. The horizontal members are fixedly attached to a supporting wall without the aid of a vertical member for height adjustment.

Hunter, U.S. Pat. No. 3,005,293 discloses a frame supporting structure for the construction of a wall facing made of brick. Horizontal U-shaped rails are attached to vertical support rails by sliding flanged edges into slots in the vertical member. Exterior flanges on the horizontal rails are slidably attached to grooves in the brick so as to hold the bricks in place to form a wall facing.

Öbrink, U.S. Pat. No. 4,262,465 teaches a mounting device for panel elements. The device shows vertical parallel mounting bars having a retaining members which close around mounting ribs attached to the back of the panel board.

Nagashima, U.S. Pat. No. 4,505,611 discloses a car door upholstery fixing device having a bracket with a tip for insertion into an aperture in the surface to be covered.

Osawa, U.S. Pat. No. 4,765,111 shows an assembly for mounting plates on a wall. The assembly includes vertical channels fixed to the interior supporting members of the wall. Within these channels are hooks over which are placed horizontal bars. Over these bars are placed supports with flanges which extend upwardly or downwardly. These support flanges are placed into grooves on the top and bottom edges of the plate material to be used as the outer wall surface. The bars appear to be horizontally movable prior to their permanent attachment to the wall supports, but no such capability is discussed.

Niwata, U.S. Pat. No. 4,977,717 teaches an apparatus for mounting panel members. The apparatus includes vertical support columns having supporting members slidably attached within a channel. The support member slidably engages a channel frame member attached to the interior face of the panel material to be mounted. Horizontal members can be connected to the vertical columns with a groove formed therein to receive the top or bottom edge of the panel member. The apparatus allows the support members to be moved vertically and also moved slightly interiorly or exteriorly before the panel member is attached.

SUMMARY OF THE INVENTION

The present invention is a modular slatwall assembly used in the construction of a wall to be formed with interior horizontal channels for securing merchandise display devices. The assembly includes an outer member defining a generally rectangular front channel and a generally rectangular rear channel. The outer member has a longitudinal front access slot defined by lips that extend forwardly from the front channel of the outer member. The outer member also has a longitudinal rear slot extending through its rear face.

Inner support members are fixed in a generally vertical fashion to the inner supports of the wall structure. Each support member defines a generally rectangular support channel. The support member has a longitudinal slot on its front face which extends the length of the member. The ends of both the outer member and inner support member are open, thus allowing access to the full cross-sectional area of the channels.

In use, the outer member and inner support members are slidably connected by a yo-yo shaped connector having two disc-like heads connected by a central post. One head of the connector is slidably situated within the support channel of the inner support member and the other head is slidably situated within the rear channel of the outer member, thus allowing horizontal and/or vertical sliding movement of the outer member. Wallboard segments having top and bottom edges that are shaped to conform to the top and bottom surfaces of the outer members are then vertically placed between the outer members to complete construction of the slatwall system.

OBJECTS OF THE INVENTION

The principal object of the present invention is to provide a slatwall assembly having modular channels which are formed independently of the wallboard material.

Another object of the invention is to provide a slatwall assembly having channels are slidably adjustable in both a horizontal and vertical manner.

A further object of this invention is to provide a slatwall assembly having channels that can be installed in any desired configuration.

A still further object of the invention is to provide a modular slatwall assembly having components that are lightweight and easy to install.

BRIEF DESCRIPTION OF THE DRAWINGS

The foregoing and other objects will become more readily apparent by referring to the following detailed description and the appended drawings in which:

FIG. 1 is a side cross-sectional view of the invented modular slatwall assembly as installed.

FIG. 2*a* is a front view of the connector.

FIG. 2*b* is a side view of the connector.

FIG. 3 is a cross-sectional top view taken along line 3—3 of FIG. 1.

DETAILED DESCRIPTION

Figure 4:
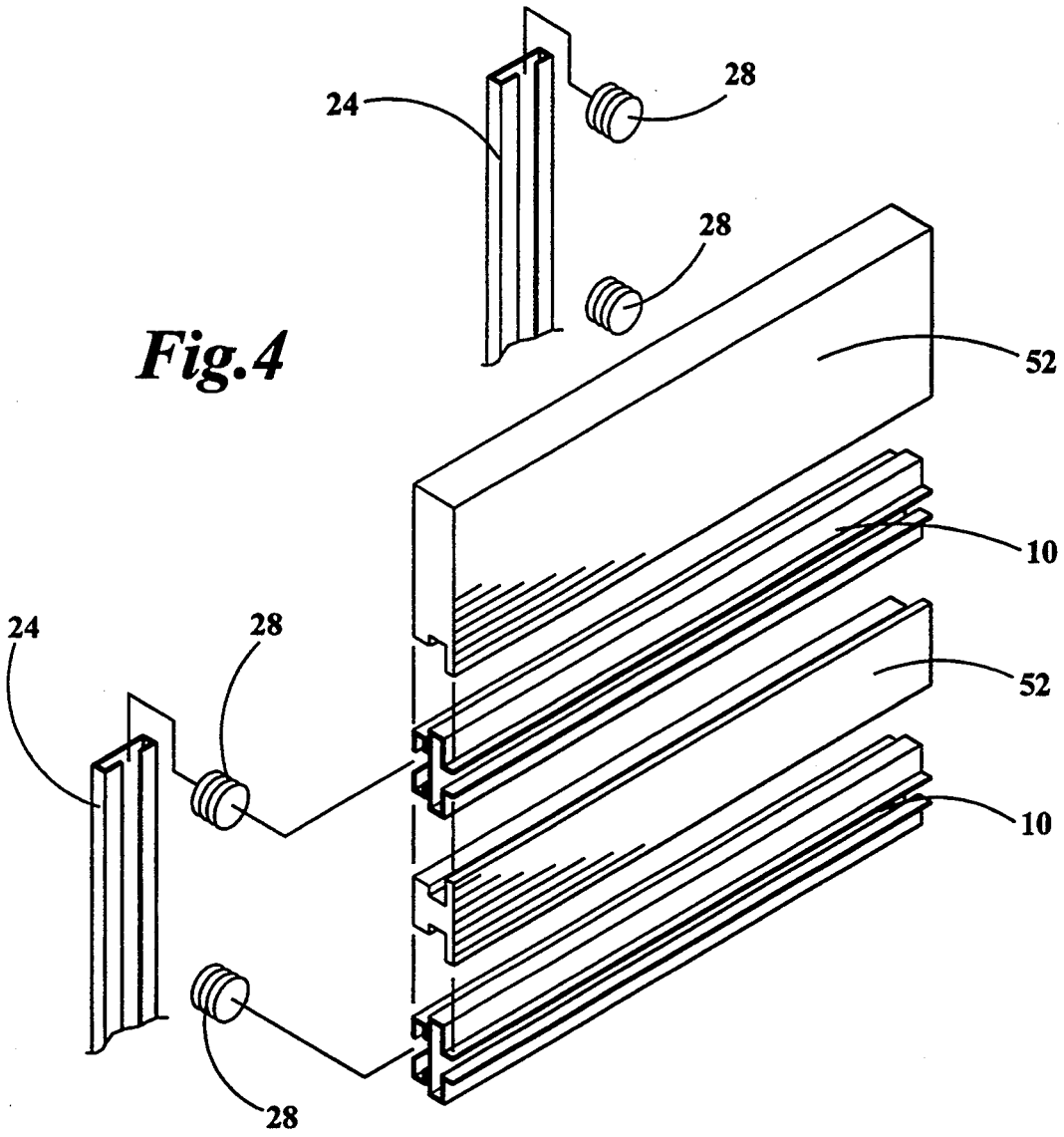
FIG. 4 is an exploded isometric view of the modular slatwall assembly.

FIGS. 1 and 2 show the modular slatwall assembly including an outer member 10 having a middle face 38 with integrally formed opposing top and bottom walls 44, 46, and a front face 36, which define a generally rectangular, longitudinal front channel 12. The middle face 38 also has depending therefrom opposing top and bottom walls 45, 47, having inwardly-turned flanges 22 defining a generally rectangular, longitudinal rear channel 14. Rear channel 14 is positioned parallel with front channel 12. The outer member 10 has a longitudinal front access slot 16 defined by an upper lip 18 and a lower lip 19 that extend forwardly or frontwardly from the front face 36 of the outer member 10. The outer member also has a longitudinal rear slot 20 defined by the edges of flanges 22 which form the rear boundary of the rear channel 14. The ends of the outer member 10 are open, thus providing access to the full cross-sectional area of the channels.

The modular slatwall assembly also includes inner support members 24 adapted to be fixed at its back wall 40 onto the inner support structure of a wall (not shown), such as studs, in a generally vertical configuration. Inner support member 24 is formed with opposing side walls having inwardly-turned perpendicular flanges 42 defining a generally rectangular, longitudinal support channel 26. The edges of flanges 42 define a longitudinal slot 27 on the support member 24. The ends of the support member are open, thereby providing access to the support channel.

The outer member and the inner support member are preferably constructed of extruded metal, such as aluminum. However, any strong material that can be shaped into the proper configuration is sufficient. By forming the channels independently of the wall surface material, the surface material will not have channels formed therein and therefore it need not be thick or strong to support the weight of merchandise placed on the display devices secured within the channels. This thinner surface material, as compared to existing slatwall surfaces, is lighter in weight and therefore easier to install than existing systems.

Outer member 10 is slidably connected to inner member 24 by connector 28 having two identical disc-like heads 30A and 30B connected by a central cylindrical post 32. In use, one head portion 30A of the connector 28 is slidably situated within the support channel 26 of the inner support member 24 while the other head portion 30B of the connector is slidably situated within the rear channel 14 of the outer member 10. The diameter and thickness of heads 30A and 30B of the connector 28 are necessarily smaller than the corresponding dimensions of the channels 24 and 14 into which they are placed, to allow longitudinal movement of the connector within the channels. Further, the diameter of the post 32 is smaller than the width of slots 20 and 27, which facilitates slidable movement of the connector through each channel. The length of the post 32 is greater than the combined thicknesses of flanges 22 and 42, thereby making the connection of the members 10 and 24 somewhat loose, thus further facilitating easy sliding of the connector within the channels 14 and 26.

In operation, at least two inner support members 24 are fixedly secured to interior wall supports, such as studs, by nails, bolts, screws, or any suitable means. One head 30 of a connector 28 is placed within each support channel 26 through its open end. The opposing heads of the connectors are then slidably situated within the rear channel 14 of the outer member 10 through the open end of the member. Since the heads of the connector are slidable within the channels, the outer member is both horizontally and vertically adjustable and may be raised, lowered, or shifted to any height, angle, or configuration depending on the display configuration desired. By adding more connectors, any number of outer members can be attached. The user must simply add sufficient outer members to achieve the required number of channels within the wall for a given display.

To fix the outer members at the appropriate height, segments of wall surface material 52, such as wood, are shaped such that their upper and lower edges conform to the shape of the bottom or top of the outer members 10. The wall surface material can be shaped by a router or other similar device. The surface material such as wallboard is then placed between each adjacent pairs of installed outer member, and between the first and last outer member and the floor or ceiling. Installation should be such that the front surface of the wall lies flush with the frontmost part of the lips 18 extending from the front face 36 of outer member 10. This construction gives the wall a smooth appearance and leaves only the front slot 16 and the front edges of lips 18 visible when viewing the outer surface of the wall. The wall surface can be further fixedly secured to the wall supports, to assist in holding the outer member in place. The wall surface material may also be held in place by its conforming fit over the outer members.

The invented assembly provides channels adapted for securing known merchandise display devices, generally shown in FIG. 1 as 53, to vertical surfaces. To utilize the constructed slatwall, merchandise display devices, such as shelves, are typically equipped with an L-shaped or hooked end. The end may be extended through the front access slot 16 and into the front channel 12 of the outer member. The display device is then held in place by resting on lower lip 19 and by its end portion, which is braced against the inner walls of the front channel 12.

ALTERNATIVE EMBODIMENTS

Figure 5:
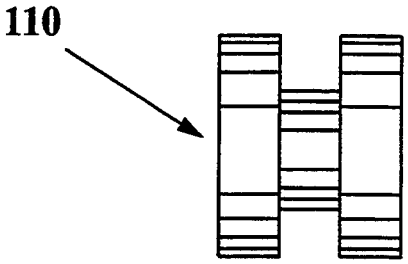
FIG. 5 is a front view of a connector having alternative relative dimensions.

The connector is configured with predetermined dimensions according to the requirements of the slatwall desired for installation. A connector 110 is shown in FIG. 5 with different ratios of head and post thickness and diameter than connector 10 as shown in FIGS. 2*a* and 2*b*.

Figure 6:
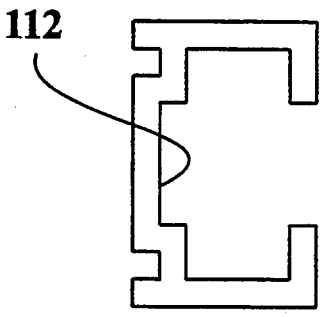
FIG. 6 is a horizontal cross-sectional view of an alternative upright support member.

An alternative horizontal cross-section of the upright support member 24 is shown in FIG. 6, which has a recess 112 in the portion of the profile which is placed against the stud, and provides clearance between the fastener head and the connector.

Figure 7:
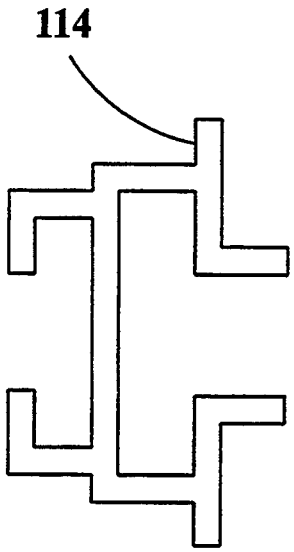
FIG. 7 is a vertical cross-sectional view of an alternative horizontal slotted member.

An alternative vertical cross-section to the member 10 is shown in FIG. 7, which has a flange 114 which improves the engagement of the horizontal member with end of the wall surface material.

Figure 8:
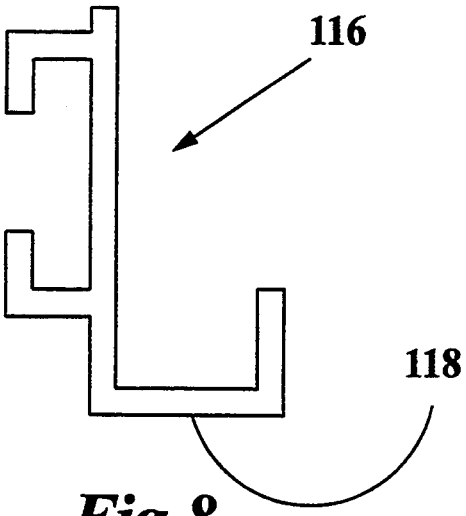
FIG. 8 is a vertical cross-sectional view an alternative horizontal member for use only in the lowermost and uppermost positions of a wall assembly.

Another alternative vertical cross-section to that of member 10 is shown as member 116 in FIG. 8, which is useful only in the lowermost and uppermost position of the wall. It has a L-shaped projection 118 which engages the end of the wall surface material without the necessity for complex shaping of the end of the wall surface material. For use as the top member of the wall, it is merely inverted. There is no shelf slot in this version, as it is not necessary.

SUMMARY OF THE ACHIEVEMENT OF THE OBJECTS OF THE INVENTION

From the foregoing, it is readily apparent that I have invented an improved slatwall assembly for displaying merchandise along the vertical surface of an upstanding or inclined wall, the slatwall assembly having modular channels formed independently of the wallboard material, which channels are slidably adjustable in both a horizontal and vertical manner, and which can be installed in any desired configuration, the slatwall assembly having components which are lightweight and more easy to install than known systems.

It is to be understood that the foregoing description and specific embodiments are merely illustrative of the best mode of the invention and the principles thereof, and that various modifications and additions may be made to the apparatus by those skilled in the art, without departing from the spirit and scope of this invention, which is therefore understood to be limited only by the scope of the appended claims.

What is claimed is:

1. A wall assembly for receiving display devices, comprising:

an outer member having a front channel adapted to receive said display devices and a rear channel;

an inner support member fixably attachable to a wall support structure;

means for slidably connecting said outer member to said inner support member; and means for adjustably fixing said outer member relative to said inner support member.

2. The assembly according to claim 1 wherein said front channel and said rear channel are substantially rectangular.

3. The assembly according to claim 1 wherein said inner support member defines a support channel.

4. The assembly according to claim 3 wherein said outer member has a rear slot in communication with said rear channel and said support member has a support slot in communication with said support channel.

5. The assembly according to claim 3 wherein said connecting means comprises a connector slidably situated within said rear channel and said support channel.

6. The assembly according to claim 5 wherein said connector comprises two opposing heads, said heads being connected by a post.

7. The assembly according to claim 6 wherein said heads are circular.

8. The assembly according to claim 3 wherein said connecting means comprises a connector having two opposing heads connected by a post.

9. The assembly according to claim 8 wherein one said head is slidably situated within said support channel and the other said head is slidably situated within said rear channel, such that said post extends through said support slot and said rear slot.

10. The assembly according to claim 1 wherein said outer member has a front face defining the front boundary of said front channel, said front face having lips depending from said front face, said lips defining a front slot in communication with said front channel.

11. The assembly according to claim 1 wherein said outer member is formed of extruded metal.

12. The assembly according to claim 1 wherein said inner support member is formed of extruded metal.

13. An assembly for providing channels on a wall for receiving display devices, comprising:

a plurality of outer members defining a generally rectangular front channel adapted to receive display devices, said front channel provided with a front access slot and a generally rectangular rear channel provided with a rear slot;

a plurality of inner support members fixedly attached to said wall, said inner support members defining a generally rectangular support channel provided with a rear slot;

a plurality connector with two head portions connected by a central post, one said head portion slidably situated within said support channel and the other said head portion slidably situated within said rear channel of said outer member, such that said post extends through said support slot and said rear slot; and means for adjustably fixing said outer member relative to said inner support member.

* * * * *